United States Patent [19]

Kemp

[11] 4,280,337

[45] Jul. 28, 1981

[54] LOW-SIDE OIL-SEPARATION AND RE-USE SYSTEM FOR AMMONIA-REFRIGERATION APPARATUS

[76] Inventor: George T. Kemp, 614 E. Locust St., Chatham, Ill. 62629

[21] Appl. No.: 109,671

[22] Filed: Jan. 4, 1980

[51] Int. Cl.[3] ..... F25B 43/02

[52] U.S. Cl. ..... 62/470; 62/503

[58] Field of Search ..... 62/470, 471, 503, 84

[56] References Cited

U.S. PATENT DOCUMENTS

| | | | |
|---|---|---|---|
| 1,106,244 | 8/1914 | Schliemann | 62/471 |
| 1,836,318 | 12/1931 | Gay | 62/471 |
| 3,304,697 | 2/1967 | Ramsey | 62/471 |
| 3,304,741 | 2/1967 | Weller | 62/471 |
| 3,438,218 | 4/1969 | O'Neil | 62/503 |
| 4,187,695 | 2/1980 | Schumacher | 62/471 |

*Primary Examiner*—Ronald C. Capossela

*Attorney, Agent, or Firm*—Ralph F. Staubly

[57] ABSTRACT

A conventional ammonia refrigeration system is modified by adding thereto an automatic oil-separation and re-use system, which comprises a gravity-type separation tank installed between the bottom of a surge drum and the compressor and an intermittently operated valve for controlling draining of the separated oil from the bottom of the separation tank. The valve is opened for a widely pre-adjustable short time period at the beginning of each compressor-ON cycle, which is when the oil has had maximal time for settling-out from its mixture with the liquid ammonia. Then the oil is safely returned to the compressor.

10 Claims, 5 Drawing Figures

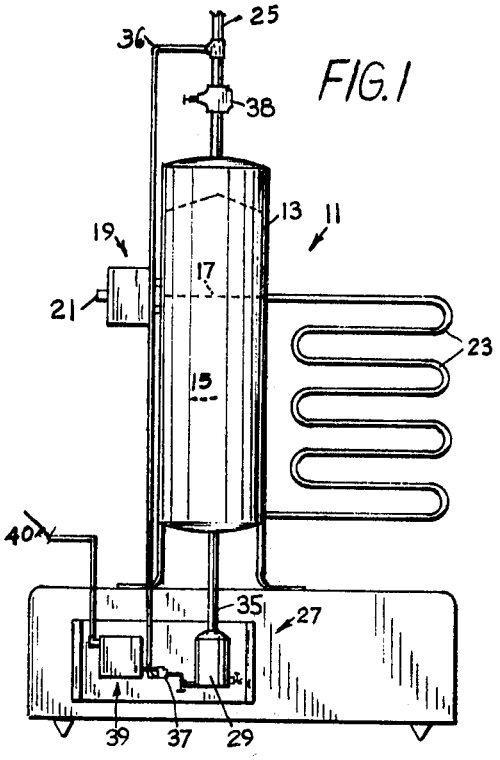
FIG. 1
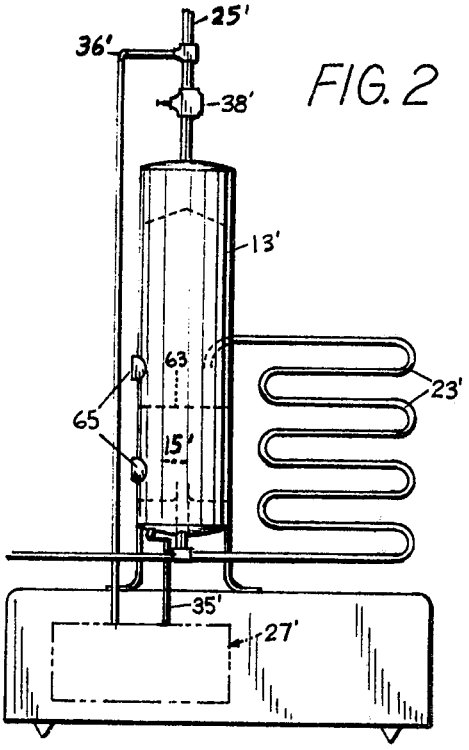
FIG. 2
FIG. 5
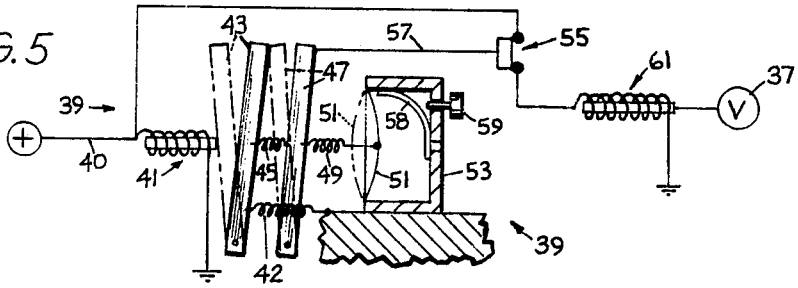
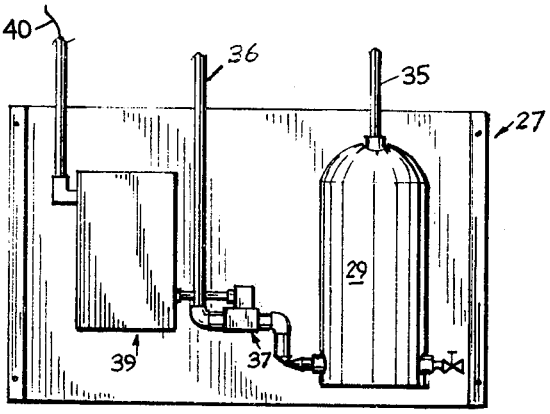
FIG 3
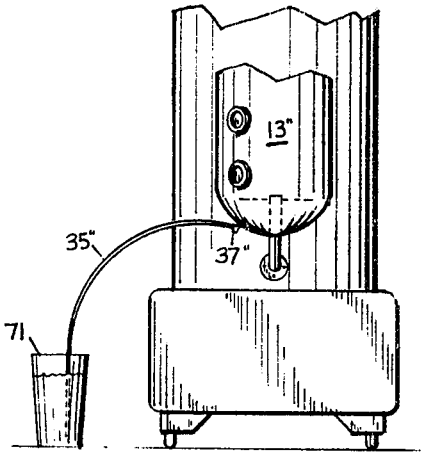
FIG. 4 (Prior Art)

LOW-SIDE OIL-SEPARATION AND RE-USE SYSTEM FOR AMMONIA-REFRIGERATION APPARATUS

BACKGROUND OF THE INVENTION

It is known to employ oil-separation and re-use systems operating in the high-pressure side of refrigeration apparatuses, e.g. U.S. Pat. Nos. 1,195,162, 1,254,519, 1,824,699, 2,002,033, 2,787,136, and 3,618,337. But none is known for operation in the low-pressure side of an ammonia system, where convenience and efficiency (nearly 100%) are higher.

SUMMARY OF THE INVENTION

This invention relates to automatic removal of oil from the low-pressure side, or evaporator part, of an ammonia-refrigeration system, returning this oil to the compressor and thereby reclaiming the same and maintaining a more efficiently operating refrigeration system. This invention is intended primarily for large (20 to 800-ton) commercial refrigeration systems using ammonia as the refrigerant. It functions only in ammonia systems, due to the fact that the ammonia refrigerant is lighter in weight than oil. Due to the design of all refrigeration compressors, oil particles from the lubrication system are continually being drawn into the compression chambers with the velocity of ammonia gases. This oil that is entrained with the refrigerant gases passes from the compressor into the discharge line; then through an oil trap where 95% to 98% of the oil is separated from the hot compressed gases and is returned to the compressor. The oil that passes through the oil trap is entrained with the ammonia gases flowing through the condenser where the hot gases are cooled and condensed to liquid ammonia. The oil particles and liquid ammonia pass from the condenser to the receiver and remain in storage at this point until the low-side controls allow the high-pressure liquid to move into the lower pressure of the low-side area. When a substance to be refrigerated passes over or through the evaporator cooling mechanism, the liquid ammonia gradually boils-off into a gaseous state. This gas is pumped by the compressor to begin another cycle. The oil that is carried into a surge drum by the liquid ammonia of the low side does not change its state and remains in circulation with the cool liquid ammonia. Over a period of time this oil will accumulate to a point where it begins to impede refrigerant circulation and cooling efficiency. It is, therefore, important that the oil trapped-out in the surge drum be removed.

Prior art FIG. 4 was taken from a service manual supplied by a large manufacturer of refrigeration systems. This old method of into-water purging of oil from the refrigeration low-side is shown in most manufacturers' service manuals. The amount of oil to be purged is in direct relationship to the size and mechanical condition of the compressor. On a compressor of 100-tons capacity, about one gallon per week must be purged. The oil purged in this manner must be disposed-of because oil contaminated with water cannot be re-used in compressors. Oftentimes during purging of this oil into a bucket of water, as shown in FIG. 4, the bucket overflows causing oil slicks on the floor. In most cases the ammonia low-sides are located in the working areas of meat-packing plants, dairies, beverage plants, etc. Many times the pungent ammonia odor becomes so noxious during the purging of the oil into a bucket of water that temporary evacuation of workers is necessary. The bucket of water containing the purged oil is often poured into a floor drain or sewer, thus creating a problem for sewerage plants.

During the normal conventional operation of any low-pressure side there are ON cycles and OFF cycles. During the ON cycle there is a very rapid movement of ammonia liquid and gases through the surge drum and cooling coils or plates. At this time there is no ammonia/oil separation. During the OFF cycle, there is no movement of ammonia liquid and gases. When there is no movement of refrigerant, ammonia/oil separation begins. During the OFF cycle any amount of oil which separates from the liquid ammonia settles to the bottom of the low-side surge drum because it is heavier. When the next ON cycle (load cycle) commences this oil will again be recirculated and mixed with the liquid ammonia. If this oil is not periodically drained, as taught herein, the circulation of the refrigerant and the cooling efficiency will be impaired.

OBJECTS OF THE INVENTION

It is the principal object of this invention to provide an automatic intermittently energized low-side oil-separation and re-use system for ammonia refrigeration apparatus which is simple and highly efficient. Other objects and advantages will appear as the following detailed description proceeds.

BRIEF DESCRIPTION OF THE DRAWING FIGURES

FIG. 1 is a largely schematic elevational view of the low-side of a typical flooded-ammonia system.

FIG. 2 is a view similar to FIG. 1 but showing the low side of a typical injector-ammonia system.

FIG. 3 is an enlarged fragmentary elevational view of the automatic-control subcombination of the left lower portion of FIG. 1.

FIG. 4 is a fragmentary elevational view illustrating the commonly used oil-wasting prior-art purging system.

FIG. 5 is a schematic diagram showing a circuit which could be employed for the automatic control.

DETAILED DESCRIPTION

With reference to FIG. 1, the numeral 11 generally designates the low-pressure side of a typical flooded-ammonia system. The system 11 comprises an accumulator or surge drum 13 in which liquid ammonia 15 is maintained at level 17 by a low-side float valve 19 controlling input through a conduit 21 from a receiver (not shown). The liquid ammonia flows from the bottom of the surge tank into an evaporator 23 where it gasifies and discharges into the upper zone of the surge tank 13 for being drawn off through a suction pipe 25 to a compressor (not shown) of known construction.

The numeral 27 generally designates the added low-side oil-control assembly which is the improvement herein disclosed. The assembly 27 comprises an oil-separation tank 29 connected to the bottom of the surge tank 13 and connected thereto by a pipe 35 through which liquid ammonia with its entrained oil flows downwardly into said oil-separation tank, and through which ammonia gas accumulated in the oil-separation tank 29 can flow upwardly.

The bottom of the oil-separation tank 29 is connected to the suction line 25 above a back-pressure-regulating valve 38 by a conduit 36. A solenoid-opened valve 37 allows separated-out oil to flow through the conduit 36 only during short periods of time at the beginning of each compressor-ON operation, so that the oil has a maximal time period (several to several hundred minutes) for settling-out from the ammonia/oil mixture during each operating cycle. This desirable feature is produced by controlling the solenoid valve 37 by a switching unit 39. The switching unit 39 can be an AC pneumatic timing relay like "class 9050, type A0-10D", manufactured by Square D Company, Milwaukee, WI, which is triggered by the control that initiates each compressor-ON operation to open the valve 37 for a preselected period of several to several hundred seconds, as is found to be needed to remove all of the oil accumulated in the oil-separation tank since the last purging operation. The timing switching unit 39 is self-resetting.

FIG. 5 schematically shows how the timing switching-unit 39 operates. When the conventional ON-control (not shown) energizes the compressor, its signal also energizes solenoid 41 to overcome the pull of spring 42 to swing armature 43 to its broken-line position, which is held during the ON-operation of the compressor. The armature 43, through tension spring 45, exerts a pull on lever 47, which pull is opposed by tension spring 49 connected to diaphragm 51. The diaphragm 51 bridges the cavity of a cup 53.

The cup 53 constitutes a time-adjustable dashpot for delaying the breaking of the circuit of a switch 55 which is operated by a push-pull rod 57 connected to the lever 47. The dashpot 53 has a leaf-spring valve 58 for controlling air intake to the dashpot chamber. The valve 58 is made adjustable by a screw 59.

As air slowly enters the chamber of the dashpot 53, the diaphragm 51 moves toward its dashed-line position for a snap-action (as it passes through its dead-center position) on the switch 55 to break the circuit to a solenoid 61 which has held the normally closed oil-draining valve 37 open since its being opened by the ON-signal from the compressor control.

FIG. 2 discloses a typical injector ammonia system in which parts like those shown in FIG. 1 are designated by the same numerals with prime (') marks added. A different level for liquid ammonia is indicated by numeral 63, and 65 designates sight glasses. Dashed line 67 is comparable to pipe 35 in FIG. 1 and shows its connection to, or instead of, a valve 69.

The invention having been described, what is claimed is:

1. In an ammonia-type refrigeration system having, in conventional assemblage, a compressor, a condensor, a surge means, and an evaporator, the improvement comprising: an oil-separation tank having upper and lower zones connected to the bottom of said surge means, a first conduit for draining settled-out oil from the bottom of said surge means into said oil-separation tank, a second conduit for conducting oil from the lower zone of said oil-separation tank to the suction intake of said compressor, a valve for controlling the flow of oil through said second conduit, and an adjustable timer-unit constructed and arranged to open said valve at the beginning of each ON portion of each ON-OFF compressor cycle and to close said valve at the end of a preselected time period after the start of each compressor-ON operation.

2. The invention according to claim 1 wherein said conventional assemblage is a typical flooded-ammonia system.

3. The invention according to claim 1 wherein said conventional assemblage is a typical injector-ammonia system.

4. The invention according to claim 1 wherein said separation tank is positioned below the bottom of said surge means.

5. The invention according to claim 1 wherein said surge means is at least partly the lower zone of a surge tank.

6. The invention according to claim 1 wherein said surge means is at least the lower portion of said evaporator.

7. The invention according to claim 1 wherein said valve is a normally closed solenoid-opened valve.

8. The invention according to claim 7 wherein the solenoid of said valve is energized by a timing unit parallelly energized by a conventional circuit for energizing the compressor motor of the system.

9. The invention according to claim 8 wherein a time-delayed-opening switch is inserted in the circuit of said solenoid for valve-closing breaking of the circuit to said solenoid a short time-period after its energization by said conventional circuit.

10. The invention according to claim 9 wherein the time-delaying part of said switch is an adjustable pneumatic dashpot.

* * * * *